US008667653B2

(12) United States Patent
Drew et al.

(10) Patent No.: US 8,667,653 B2
(45) Date of Patent: Mar. 11, 2014

(54) CASKET CAP PANEL INSERT WITH APPLIQUE APPLIED THERETO

(71) Applicant: Batesville Services, Inc., Batesville, IN (US)

(72) Inventors: Travis Edward Drew, Batesville, IN (US); Daniel J. Parker, Connersville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 13/767,388

(22) Filed: Feb. 14, 2013

(65) Prior Publication Data

US 2013/0232744 A1 Sep. 12, 2013

Related U.S. Application Data

(60) Provisional application No. 61/608,254, filed on Mar. 8, 2012.

(51) Int. Cl.
*A61G 17/00* (2006.01)

(52) U.S. Cl.
USPC ..... 27/19; 27/14; 40/606.03

(58) Field of Classification Search
USPC ..... 27/14, 16, 19, 2; 40/798, 606.03, 725, 40/737, 489; D99/8, 10, 12
See application file for complete search history.

(56) References Cited

U.S. PATENT DOCUMENTS

| | | | | |
|---|---|---|---|---|
| 2,664,615 | A | 1/1954 | Hillenbrand et al. | |
| 2,947,059 | A | 8/1960 | Hillenbrand | |
| 2,964,824 | A | 12/1960 | Hillenbrand | |
| 3,157,936 | A | 11/1964 | Hillenbrand | |
| 4,058,215 | A * | 11/1977 | Marchbank | 206/574 |
| 4,357,741 | A | 11/1982 | Winburn et al. | |
| 4,657,608 | A | 4/1987 | Schebler et al. | |
| 5,072,532 | A * | 12/1991 | Kelly | 40/745 |
| 5,636,419 | A | 6/1997 | Foye | |
| 5,675,877 | A | 10/1997 | Lewis | |
| D414,308 | S | 9/1999 | Agee et al. | |
| D424,779 | S | 5/2000 | Agee et al. | |
| 6,237,202 | B1 | 5/2001 | Agee et al. | |
| 6,742,231 | B1 | 6/2004 | Calhoun et al. | |
| 7,159,287 | B2 | 1/2007 | Parker et al. | |
| 7,401,391 | B2 * | 7/2008 | Maple et al. | 27/19 |
| 7,584,529 | B1 | 9/2009 | Parker | |
| 7,657,981 | B2 * | 2/2010 | Parker | 27/19 |
| 8,220,119 | B2 * | 7/2012 | Burlage et al. | 27/14 |

(Continued)

*Primary Examiner* — William Miller
(74) *Attorney, Agent, or Firm* — Wood, Herron & Evans, LLP

(57) ABSTRACT

A casket comprises a casket shell adapted to receive the remains of a deceased having a pair of side walls, a pair of end walls, and a bottom wall, and a casket cap. The cap includes a dish assembly mounted to an underside of the cap. The dish assembly includes a cap panel, a pair of opposed puffings attached to opposed longer sides of the cap panel, a pair of opposed puffings attached to opposed shorter sides of the cap panel, and at least a pair of generally horizontally spaced apart and generally vertically extending pleats. An appliqué panel overlies the cap panel and is sized and configured such that its opposite side edges are removably received and retained by respective ones of the pair of pleats. The appliqué panel is transparent to allow viewing of the cap panel behind it, and includes an embroidered appliqué applied on its front face. The appliqué panel thereby creates a three-dimensional appearance of the embroidery floating in front of the cap panel.

20 Claims, 3 Drawing Sheets

(56) References Cited

U.S. PATENT DOCUMENTS

| | | | | |
|---|---|---|---|---|
| 8,307,519 | B2 * | 11/2012 | Drew et al. | 27/19 |
| 2004/0158960 | A1 * | 8/2004 | Shaw | 27/14 |
| 2005/0150091 | A1 * | 7/2005 | Parker et al. | 27/19 |
| 2008/0086855 | A1 | 4/2008 | Maple et al. | |
| 2009/0282657 | A1 | 11/2009 | Parker | |
| 2010/0299895 | A1 | 12/2010 | Burlage et al. | |
| 2011/0067212 | A1 | 3/2011 | Drew et al. | |
| 2013/0074299 | A1 | 3/2013 | Rojdev | |

* cited by examiner

CASKET CAP PANEL INSERT WITH APPLIQUE APPLIED THERETO

RELATED APPLICATIONS

This application claims the priority benefit of U.S. Provisional Patent Application No. 61/608,254 filed Mar. 8, 2012, which is hereby incorporated by reference herein as if fully set forth in its entirety.

FIELD OF THE INVENTION

This invention relates generally to caskets, and more particularly to caskets having customization/personalization features.

BACKGROUND OF THE INVENTION

A conventional casket has a casket shell adapted to receive the remains of a deceased, and either a single lid or cap, or pair of lids or caps, pivoted to the shell. Single lid caskets are sometimes referred to as "full top" or "full couch" caskets, whereas caskets with separate head end and foot end lids are sometimes referred to as "split top" or "half couch" caskets. During viewing of a body in a split top casket, only the head end cap is raised, while during viewing of a body in a full top casket, the single full length cap is of course raised. In either instance, the interior of the casket is visible. It has heretofore been conventional to trim the interior of the casket (both the interior of the casket shell and the underside of the casket lid) with various decorative interior trim components to present an ornamentally pleasing appearance when the lid or lids is or are open.

In the case of the casket lid or lids, decorative trim components are provided for the underside of the casket lid, visible when the lid is open. A "dish assembly" is typically mounted within the underneath side of the lid. The dish assembly includes a generally rectangular cap panel and four convexedly shaped "puffing members" (or simply "puffings") mounted around the periphery of the cap panel to the opposed longer sides and the opposed shorter ends of the cap panel. The dish assembly may or may not include a decorative cap panel insert that is removably installable and frictionally retained between the four puffing members of the dish assembly. The cap panel and/or cap panel insert may be covered in decorative fabric or otherwise have ornamentation applied thereto such as embroidery or the like which complements the fabrics used in the interior of the casket shell.

There is a trend in the death care industry towards "personalization"—the personalizing of funeral products and funeral, memorial or other services purchased for the deceased, to provide a more meaningful experience for the family and friends of the deceased. Oftentimes, there is a desire on the part of the deceased's family and loved ones to memorialize the faithfully departed. This may manifest itself in several ways such as, for example, displaying various religious or sentimental items close to or on or in the casket during viewing of the deceased. Another way is that the family may personalize the casket to the deceased by choosing various decorative or ornamental embellishments for the casket that represent a life aspect of the deceased.

To personalize the casket to the deceased, the cap panel, or as is more customary the cap panel insert, can be chosen with a design, emblem, or other ornamentation that portrays a life aspect of the deceased. In this way the loved one of the deceased is able to personalize the casket to the deceased. A funeral home may stock a number of different cap panel inserts from which a customer may select, with each one having a different design, emblem, or ornamentation pre-applied thereto as by embroidery or the like. In this way a family member may choose the cap panel insert that has the appropriate design, emblem, or ornamentation to portray the chosen life aspect of the deceased.

One innovation in the area of personalization of the dish assembly may be seen with reference to the assignee's U.S. Pat. Nos. 6,237,202 and 6,446,315, hereby incorporated by reference herein as if fully set forth in their entirety. These patents disclose a dish assembly that has a cap panel with a framed opening that accepts a framed cap panel insert that is removably received in the cap panel opening frame. The cap panel insert can be personalized to the deceased. The cap panel insert can be removed from the cap subsequent to a memorial service for the deceased and retained by the loved one of the deceased as a memorial to the deceased.

Another innovation in the area of personalization of the dish assembly may be seen with reference to the assignee's U.S. Pat. No. 8,220,119 titled Memorialization Casket And Method, hereby incorporated by reference herein as if fully set forth in its entirety. This patent discloses a dish assembly that has a cap panel made of magnetic material, and a magnetic ornament, such as a medallion, magnetically attached to cap panel.

Yet another innovation in the area of dish assembly personalization may be seen with reference to the assignee's U.S. Pat. No. 8,307,519 titled Memorialization Casket, hereby incorporated by reference herein as if fully set forth in its entirety. This patent discloses a dish assembly that has a cap panel with at least one pair of opposed retention members sized and configured to receive and retain the opposite side edges of a photograph for display of the photograph.

Despite the advancements made in the area of personalization of dish assemblies of caskets as demonstrated above, there remains room for improvement.

SUMMARY OF THE INVENTION

In one aspect, a casket comprises a casket shell adapted to receive the remains of a deceased having a pair of side walls, a pair of end walls, and a bottom wall, and a casket cap closable on the casket shell. The cap includes a dish assembly mounted to an underside of the cap. The dish assembly includes a cap panel, a pair of opposed puffings attached to opposed longer sides of the cap panel, a pair of opposed puffings attached to opposed shorter sides of the cap panel, and at least a pair of generally horizontally spaced apart and generally vertically extending pleats. An appliqué panel overlies the cap panel and is sized and configured such that its opposite side edges are removably received and retained by respective ones of the pair of pleats. The appliqué panel is transparent to allow viewing of the cap panel behind it, and includes an embroidered appliqué applied on its front face. The appliqué panel thereby creates a three-dimensional appearance of the embroidery floating in front of the cap panel.

The appliqué panel can have a matte finish or be etched plastic to reduce glare. It can also have rounded corners to minimize snagging on fabric on the cap panel. The appliqué panel is preferably fabricated of semi-rigid yet flexible plastic. For example, the appliqué panel can be fabricated of about 0.045 inch thick polyester acrylic.

In another aspect, a dish assembly for mounting to an underside of a casket cap of the type discussed above is provided.

In another aspect, a casket comprises a casket shell adapted to receive the remains of a deceased having a pair of side walls, a pair of end walls, and a bottom wall, and a casket cap closable on the casket shell. The cap includes a dish assembly mounted to an underside of the cap. The dish assembly includes a cap panel, a pair of opposed longer puffings attached to opposed longer sides of the cap panel, a pair of opposed shorter puffings attached to opposed shorter sides of the cap panel, and at least a pair of spaced apart retention members. An appliqué panel overlies the cap panel and is sized and configured such that its opposite side edges are removably received and retained by respective ones of the retention members. The appliqué panel is transparent to allow viewing of the cap panel behind it, and includes an appliqué applied on its front face. The appliqué panel thereby creates a three-dimensional appearance of the appliqué floating in front of the cap panel.

The appliqué can be embroidery. The pair of retention members can be the pair of longer puffings, the pair of shorter puffings, or a pair of generally horizontally spaced apart and generally vertically extending pleats, or a combination thereof.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
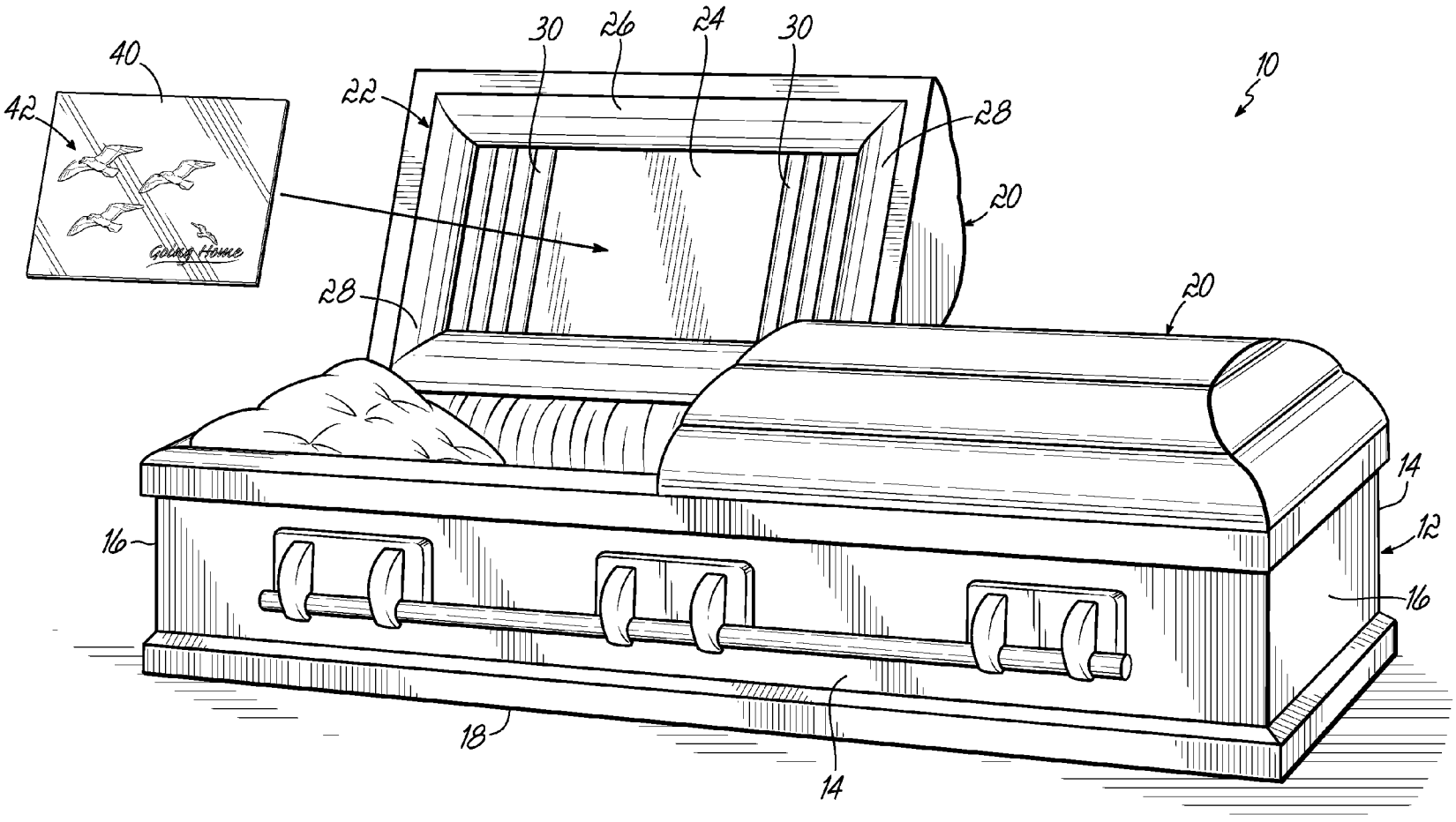
FIG. 1 is a perspective view of a casket according to the principles of the present invention.

Referring first to FIG. 1, a casket 10 has a shell 12 adapted to receive the remains of a deceased having a pair of side walls 14, 14, a pair of end walls 16, 16, and a bottom wall 18, and a cap 20 closable on the shell 12. The casket may have a pair of caps or a single cap the full length of the casket. As used herein "cap" or "lid" is deemed to generically embrace both.

Cap 20 has an ornamental dish assembly 22 mounted to an underside of the cap 20. The dish assembly 22 includes a cap panel 24, a pair of opposed longer puffings 26, 26 attached to opposed longer sides of the cap panel 24, a pair of opposed shorter puffings 28, 28 attached to opposed shorter sides of the cap panel 24, and at least a pair of spaced apart retention members 30, 30. Puffings 26, 26 and 28, 28 are attached to the cap panel 24 by means known to those skilled in the art, for example staples, adhesives, etc. The dish assembly 22 is mounted and retained in the underside of the cap 20 by means known to those skilled in the art as well. In the illustrative and exemplary embodiment shown, retention members 30, 30 are one pair of several pairs of decorative pleats, but could be other structures as well, and for that matter could even be the pair of opposed longer puffings 26, 26 and/or the pair of opposed shorter puffings 28, 28. The illustrated pleats can be so-called "pleat boards" fabricated of a flexible yet semi-rigid material, for example chipboard, covered with decorative fabric, and attached to cap panel 24 with adhesives, staples, and the like. For a discussion of pleat boards and their construction see U.S. Pat. No. 8,307,519.

Figure 2:
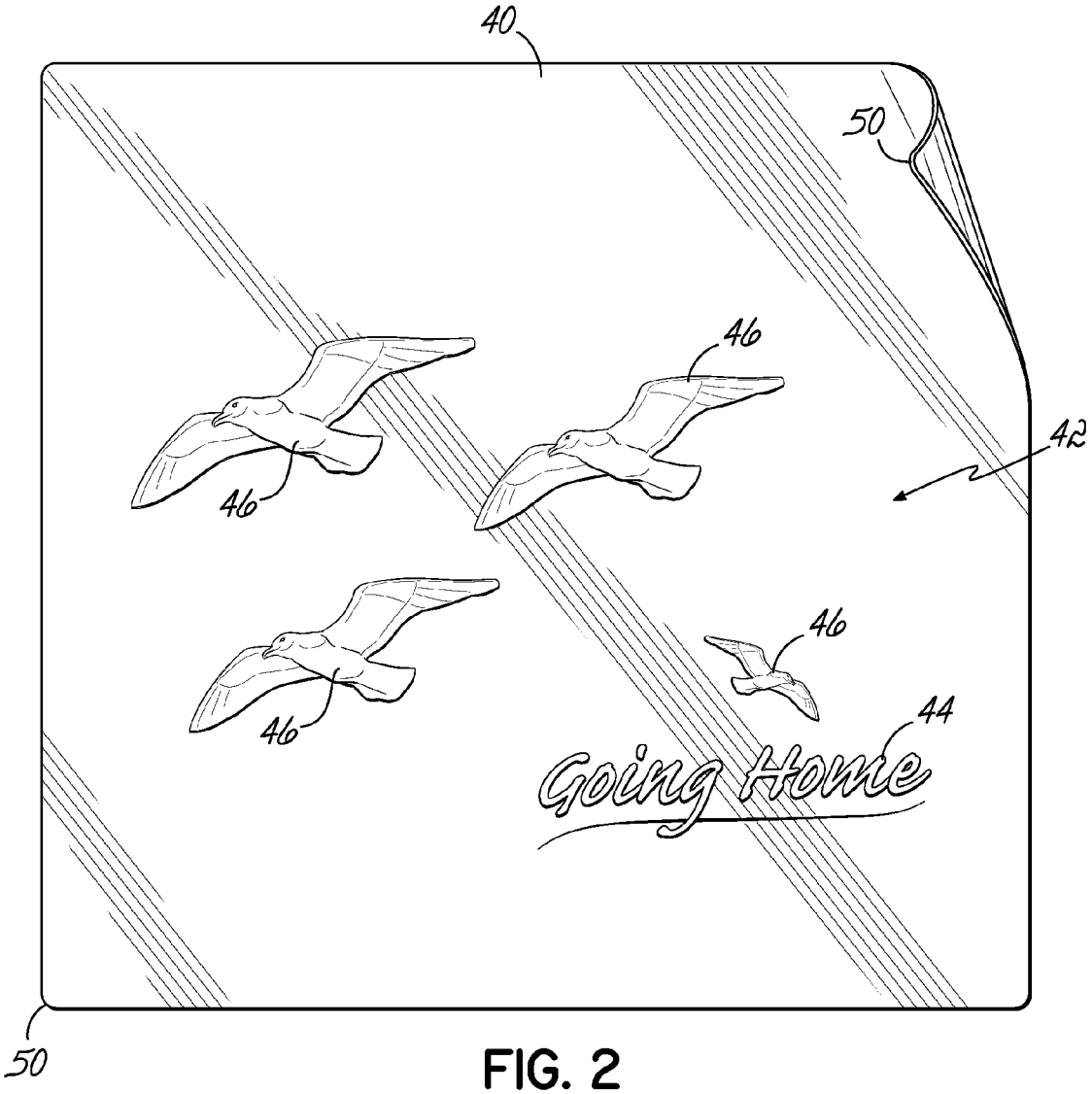
FIG. 2 is a top plan view of an appliqué panel for the dish assembly of the casket of FIG. 1.
Figure 3:
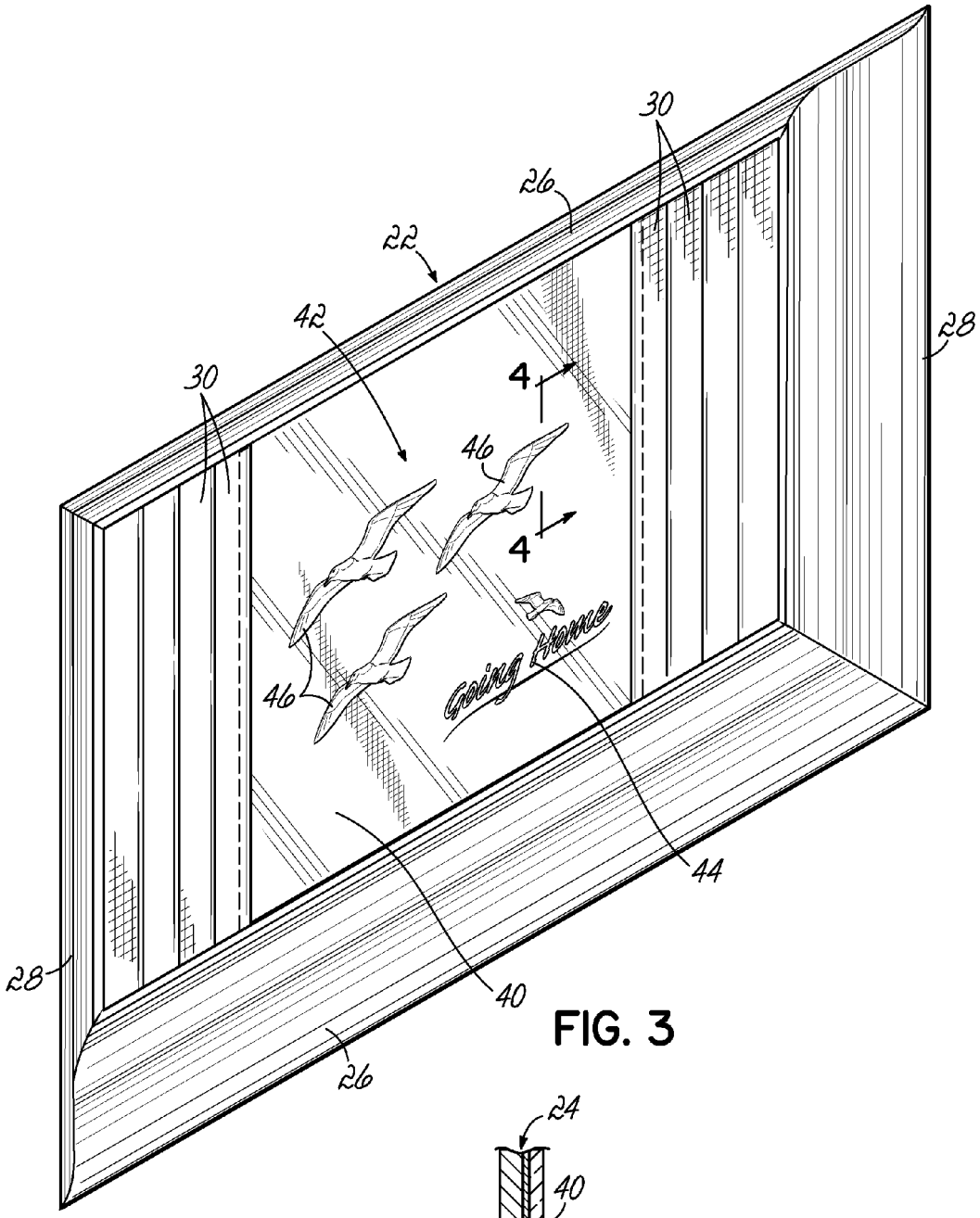
FIG. 3 is a perspective view of the dish assembly of FIG. 1 with the appliqué panel of FIG. 2 installed therein.

Referring now to FIGS. 1-3, respective ones of the retention members 30, 30 are sized and configured to receive and retain the opposite side edges of an appliqué panel 40 that overlies the cap panel 24. The appliqué panel 40 is transparent to allow viewing of the cap panel 24 behind it, and includes an embroidered appliqué 42 applied on its front face. Embroidered appliqué 42 can take the form of text 44 and/or non-textual designs 46. Any suitable means of securing the embroidery 42 to the appliqué panel 40 can be used, such as adhesives, double-sided tape, or the like.

Figure 4:
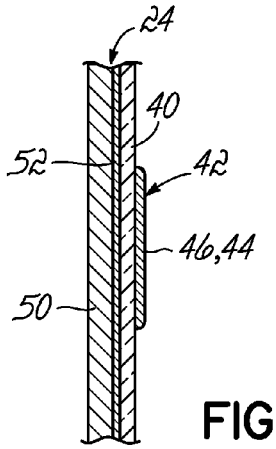
FIG. 4 is a cross-sectional view taken along line 4-4 in FIG. 3.

Referring now to FIGS. 3 and 4, it can readily be appreciated that the appliqué panel 40 creates a three-dimensional appearance of the embroidery 42 floating in front of the cap panel 24. More particularly, in FIG. 4 it can be seen that cap panel 24 can comprise a substrate 50 of cardboard, chipboard, or the like, which is covered by decorative fabric 52. Appliqué panel 40 overlies the fabric 52 of the cap panel 24, and the embroidery 42 overlies the appliqué panel 40. Thus, due to the embroidery 42 being spaced away from the fabric of 52 of the cap panel 24 by the thickness of the appliqué panel 40, and due to the appliqué panel 40 being transparent, the embroidery 42 appears to "float" in front of the cap panel 24, and hence the three-dimensional effect.

The appliqué panel 40 preferably has a matte finish to reduce glare. Alternatively the appliqué panel 40 can be fabricated of etched plastic to reduce glare. The appliqué panel 40 preferably includes rounded corners 50 to minimize snagging on the fabric 52 on the cap panel 24 during installation. The appliqué panel 40 is preferably fabricated of semi-rigid yet flexible plastic. For example, one suitable material from which to fabricate the appliqué panel 40 is about 0.045 inch thick polyester acrylic.

Installation of the appliqué panel 40 is quick and easy. The side edge of one side of the appliqué panel 40 is first slid behind one pleat 30, and then the side edge of the other side of the appliqué panel 40 is slid behind the other pleat 30. The appliqué panel 40 is then centered horizontally between the pleats 30, 30 and installation is complete.

Appliqué panels 40 will allow a funeral director to quickly and easily customize and personalize a casket based on the needs and desires of a customer. A casket manufacture need make, and a funeral director need stock, only a single dish assembly with a "plain" or universal cap panel. Then, by having a number of appliqué panels 40 on hand with various designs, the funeral director can quickly and easily change the theme of the cap panel and hence casket. Yet, due to the design of the appliqué panels 40, the dish assembly will retain the look of an embroidered cap panel.

Note that while the practice of the present invention is particularly suited to the use of embroidered appliqués on the appliqué panel to replicate the look of embroidered cap panels/cap panel inserts, embroidery is not required to be used as the appliqué, and in fact, other types of appliqués could be used. Examples of other types of appliqués that can be used, and that are deemed embraced by the claims, are printed paper adhesive appliqués, domed appliqués, etc.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. A casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed puffings attached to opposed longer sides of said cap panel and a pair of opposed puffings attached to opposed shorter sides of said cap panel, and at least a pair of generally horizontally spaced apart and generally vertically extending pleats, and an appliqué panel overlying said cap panel and sized and configured such that opposite side edges of said appliqué panel are removably received and retained by respective ones of said pair of pleats, said appliqué panel being transparent to allow viewing of said cap panel therebehind, said appliqué panel including an embroidered appliqué applied on a front face thereof, said appliqué panel thereby creating a three-dimensional appearance of the embroidery floating in front of said cap panel.

2. The casket of claim 1 wherein said appliqué panel has a matte finish to reduce glare.

3. The casket of claim 1 wherein said appliqué panel is etched plastic to reduce glare.

4. The casket of claim 1 wherein said appliqué panel has rounded corners to minimize snagging on fabric on said cap panel.

5. The casket of claim 1 wherein said appliqué panel is fabricated of semi-rigid yet flexible plastic.

6. The casket of claim 1 wherein said appliqué panel is fabricated of about 0.023 inch thick polyster acrylic.

7. A casket dish assembly adapted to be mounted to an underside of a casket cap, said dish assembly comprising:

a cap panel, a pair of opposed puffings attached to opposed longer sides of said cap panel and a pair of opposed puffings attached to opposed shorter sides of said cap panel, and at least a pair of generally horizontally spaced apart and generally vertically extending pleats, and an appliqué panel overlying said cap panel and sized and configured such that opposite side edges of said appliqué panel are removably received and retained by respective ones of said pair of pleats, said appliqué panel being transparent to allow viewing of said cap panel therebehind, said appliqué panel including an embroidered appliqué applied on a front face thereof, said appliqué panel thereby creating a three-dimensional appearance of the embroidery floating in front of said cap panel.

8. The dish assembly of claim 7 wherein said appliqué panel has a matte finish to reduce glare.

9. The dish assembly of claim 7 wherein said appliqué panel is etched plastic to reduce glare.

10. The dish assembly of claim 7 wherein said appliqué panel has rounded corners to minimize snagging on fabric on said cap panel.

11. The dish assembly of claim 7 wherein said appliqué panel is fabricated of semi-rigid yet flexible plastic.

12. The dish assembly of claim 7 wherein said appliqué panel is fabricated of about 0.023 inch thick polyster acrylic.

13. A casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, a pair of opposed longer puffings attached to opposed longer sides of said cap panel and a pair of opposed shorter puffings attached to opposed shorter sides of said cap panel, and at least a pair of spaced apart retention members, and an appliqué panel overlying said cap panel and sized and configured such that opposite side edges of said appliqué panel are removably received and retained by respective ones of said retention members, said appliqué panel being transparent to allow viewing of said cap panel therebehind, said appliqué panel including an appliqué applied on a front face thereof, said appliqué panel thereby creating a three-dimensional appearance of said appliqué floating in front of said cap panel, said appliqué adhered to said appliqué panel, said opposite side edges of said appliqué panel positioned between said retention members and said cap panel, said appliqué panel being significantly larger than said appliqué applied thereon, said appliqué applied to a generally central region of said appliqué panel well within a perimeter of said appliqué panel, whereby a substantial portion of said cap panel behind said appliqué panel is viewable through said appliqué panel and not obscured by said appliqué.

14. The casket of claim 13 wherein said at least a pair of retention members are at least one of a group consisting of: a) said pair of longer puffings, b) said pair of shorter puffings, and c) a pair of generally horizontally spaced apart and generally vertically extending pleats.

15. The casket of claim 13 wherein said appliqué is embroidery.

16. The casket of claim 13 wherein said appliqué panel has a matte finish to reduce glare.

17. The casket of claim 13 wherein said appliqué panel is etched plastic to reduce glare.

18. The casket of claim 13 wherein said appliqué panel has rounded corners to minimize snagging on fabric on said cap panel.

19. The casket of claim 13 wherein said appliqué panel is fabricated of semi-rigid yet flexible plastic.

20. The casket of claim 13 wherein said appliqué panel is fabricated of about 0.023 inch thick polyster acrylic.

* * * * *